United States Patent [19]

Silver

[11] 4,085,475

[45] Apr. 25, 1978

[54] SCOURING DEVICE

[76] Inventor: Louis J. Silver, 3434 Baker St., San Francisco, Calif. 94123

[21] Appl. No.: 730,372

[22] Filed: Oct. 7, 1976

Related U.S. Application Data

[63] Continuation-in-part of Ser. No. 638,348, Dec. 8, 1975, abandoned.

[51] Int. Cl.[2] ..... A47L 17/08

[52] U.S. Cl. ..... 15/209 D; 15/151

[58] Field of Search ..... 15/104.94, 209 B, 209 D, 15/209 R, 244 R, 151; 51/392, 393; D7/178

[56] References Cited

U.S. PATENT DOCUMENTS

| | | | |
|---|---|---|---|
| 1,653,652 | 12/1927 | Melniker | 15/209 D |
| 1,678,962 | 7/1928 | Stark et al. | 15/209 D |
| 2,778,049 | 1/1957 | Meyer | 15/209 D |
| 3,060,478 | 10/1962 | Silver | 15/209 D |
| 3,100,311 | 8/1963 | Tutino | 15/209 D |
| 3,105,989 | 10/1963 | Bell et al. | 15/209 D |
| 3,645,821 | 2/1972 | Baumann | 15/244 R X |

FOREIGN PATENT DOCUMENTS

| | | | |
|---|---|---|---|
| 297,342 | 6/1954 | Switzerland | 15/209 D |

*Primary Examiner*—Daniel Blum

*Attorney, Agent, or Firm*—Owen, Wickersham & Erickson

[57] ABSTRACT

A scouring device in which a shaped scouring pad is held up into a rigid skirt portion of a pad holder, the skirt portion being generally concave and having downwardly extending projections, by a securing member which has a washer-like member at its base and a stem extending up to a flattened axial portion which goes through a slit in the holder and then is turned about 90°. This, together with projections on the bottom of the pad holder, hold the pad in place. A rigid handle portion extends up above the skirt, and forms the perimeter of a cavity into which the flattened axial portion of the securing member projects. The outer wall of this handle portion is provided with ridges and grooves to give a better grip to one's hand, which can then place pressure almost directly on the underlying pad. Since the pad is forced into a somewhat concave position, the base of the securing member is lifted above the scouring surface and a better scouring surface is provided.

14 Claims, 13 Drawing Figures

FIG. 1
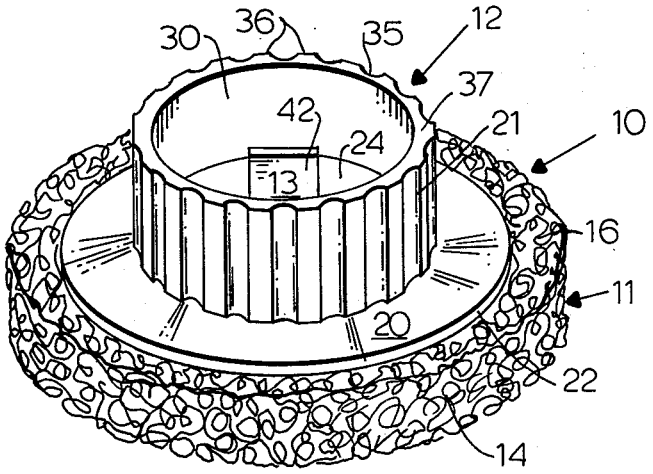
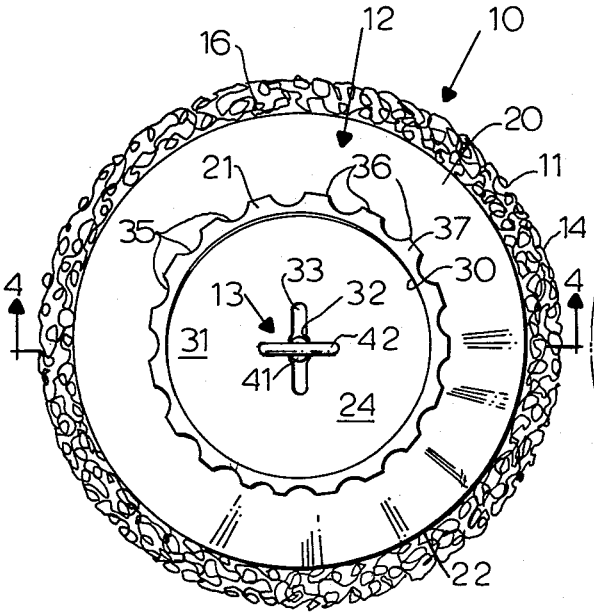
FIG. 2
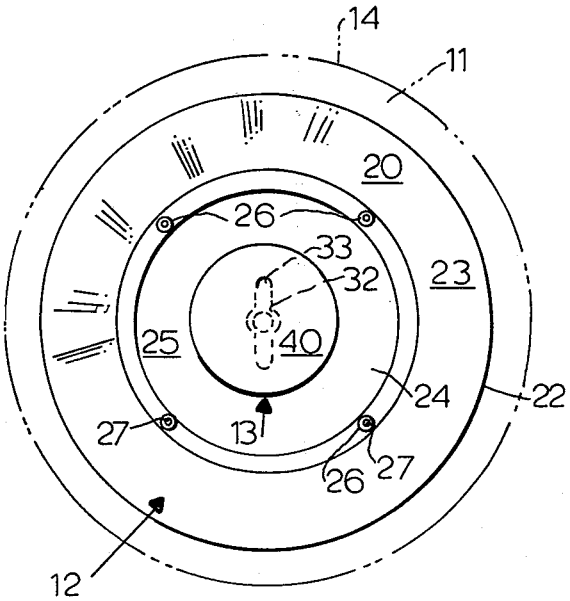
FIG. 3
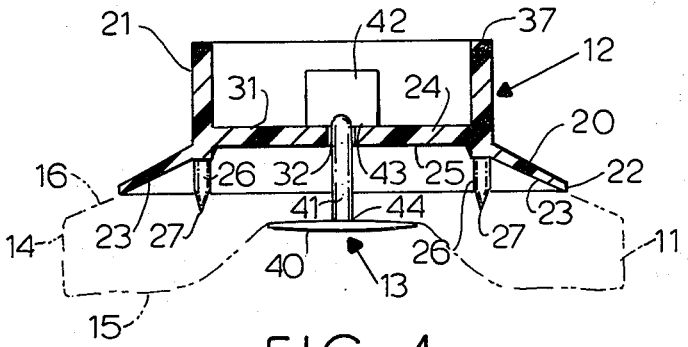
FIG. 4

FIG. 10
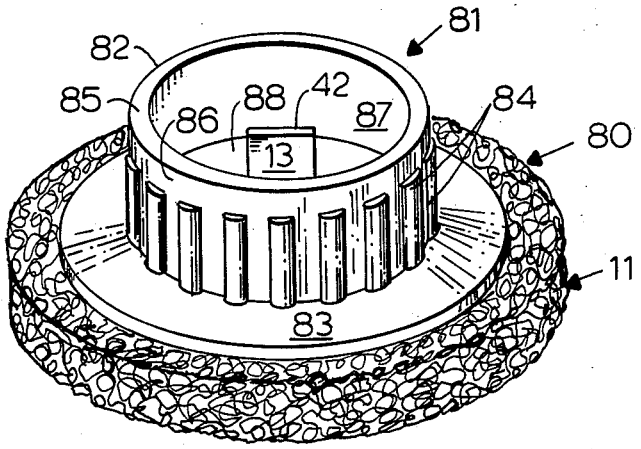
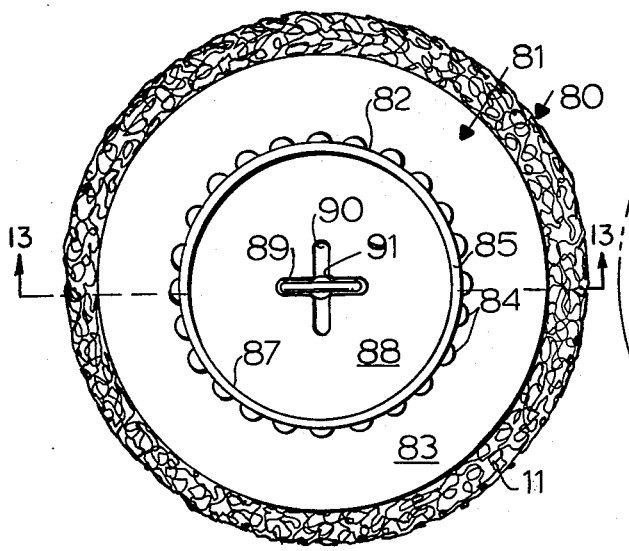
FIG. 11
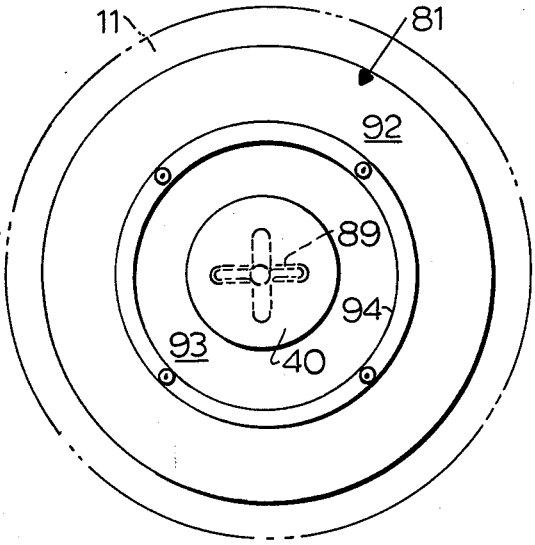
FIG. 12
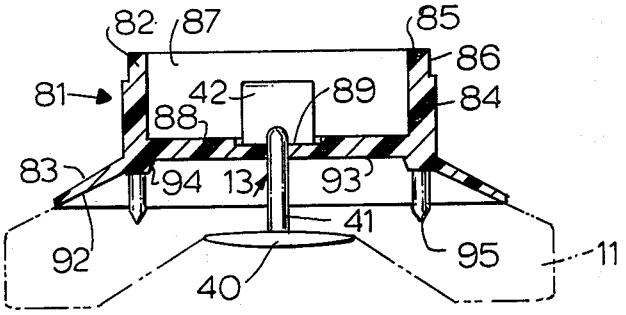
FIG. 13

SCOURING DEVICE

REFERENCE TO RELATED APPLICATION

This application is a continuation-in-part of application Ser. No. 638,348, filed Dec. 8, 1975, now abandoned.

BACKGROUND OF THE INVENTION

This invention relates to an improved scouring device.

When scouring pads are used without holders, they are often injurious to the hands and at best are uncomfortable; sometimes they cannot be securely grasped.

Some such pads seem to be incapable of being provided with holders, at least as a practical matter. Into this classification fall steel wool and cotton waste, both of which soon crumble away from any type of holder when they are subjected to even normal use. Attempts to provide satisfactory holders for pads of steel wool or cotton waste have been made by (1) Melniker (U.S. Pat. No. 1,653,652) with a flexible holder having various means for engaging the pad, none of which work for long; (2) Bell et al, with arcuate fingers in U.S. Pat. No. 3,105,989; (3) Meyer in U.S. Pat. No. 2,778,049 with transverse prongs or tines; and (4) Stark et al in U.S. Pat. No. 1,678,962, with a flat-headed nail. Many other attempts have been made.

Other types of pads can be used with holders, including the type shown in my earlier U.S. Pat. No. 3,060,478, where a woven wire pad is shown and others mentioned. These pads can be used with the present invention. The trouble in my earlier device has been that the handle shown in that patent, like the handle on metal brushes, renders it difficult to get into small spaces, limits the amount of force that can be applied, and tends to break off in face of excessive force.

Some devices have been placed on the market having reasonably good handles, but in these, where the scouring pad is satisfactory, the pad has been permanently secured to the handle so that once the pad itself wore out, the entire device had to be discarded, as have metal brushes when one end is worn down. This is, of course, very uneconomical, because the life of the scouring pad itself may be relatively short when compared to that of the handle, and although the handle may be not necessarily expensive, it is a waste to throw it away. Moreover, a better handle can be made and sold if the purchaser understands that its life extends far beyond the life of a single pad.

A corollary of the need for a better handle is the need for securing means which is adequate to such a handle and which can itself be relatively inexpensive.

Thus, among the objects of the invention are to provide an improved holder for a scouring device, to provide a scouring device by which the user can get a very good grasp for holding the device while scouring with considerable force and in small spaces, to enable the user to get a secure hand grip without having to hold on to the scouring pad itself, to enable the user to exert strong force almost directly through the scouring pad onto the object being scoured, to hold the pad (which must itself be suitable for holding) very securely to the handle, to provide a scouring device in which the pad can be reversed in the pad holder to use both sides of the pad, thereby getting twice as much use per pad, to provide a scouring device in which the pad holder can be used again and again by simply placing a new scouring pad into it and discarding a consumed scouring pad, and to provide such a renewal of pads that the device is economical to use over a long period of time.

SUMMARY OF THE INVENTION

The scouring device of this invention is made up of three elements: the scouring pad itself, a holder for the pad, and a securing device that links together the pad and the holder.

The scouring pad itself may be like that shown in my earlier U.S. Pat. No. 3,060,478. It must be a type of pad that does not fall apart or readily tear apart, as do the usual steel wool pads or cellulose sponges, etc., or a pad of metal turnings. The scouring pads useful in this invention have substantially flat upper and lower surfaces and a regular perimeter, whether round, rectangular, or other. Preferably, the pad has a natural resiliency in itself, such as a woven wire pad, or a fibrous plastic pad, such as nylon, which holds together for working on Teflon and other such coatings, as well as on non-coated pots and pans. All such scouring pads have natural resilience and have a suitable roughened surface for accomplishing the scouring. In other words, one uses a heavy duty pad for steel and iron pans, with or without abrasives, and uses a soft nylon pad for Teflon or (with abrasives) for metals.

The pad holder of this invention has a rigid skirt portion with a regular perimeter, and if it is generally like that of the pad, is smaller. The rigidity is important for the application of the necessary force. A flexible device like that of the Melniker U.S. Pat. No. 1,653,652, is not capable of the desired operation. The hand may rest on the skirt without touching the pad; the rigidity enables force to be applied there too. The perimeter of the skirt may be circular for a circular pad, but the circle will be of shorter radius than that of the pad. Again, it may be rectangular, but the size of the rectangle will be smaller than that of the pad. The pad projects beyond the holder all around the edges of the holder. This rigid skirt or flange portion has a generally concave lower surface and has some downwardly extending projections that serve to engage the pad and help to hold it in place.

The pad holder also has an upwardly extending rigid handle portion that is coaxial with the rigid skirt portion and is immediately above it. Preferably, the handle forms a cylindrical or rectangular rim with at least portions of the outer wall having ridges and grooves to provide a good gripping surface. Moreover, the user's hands can rest on and push down in the skirt or flange. The handle itself thus projects up from the skirt—the skirt and handle are preferably molded integrally for greater strength—and within the handle is a cavity having a central opening through its bottom wall which preferably provides a central rounded opening portion with a flat slit extending out of each side of center.

The invention requires three parts—the pad, the pad holder, and the securing member, and all are necessary. The securing member for locking the pad to the holder has a generally flat broad base and an upwardly extending stem. At the upper end of the stem is a flattened axial extension that can be inserted through the slit in the bottom wall of the holder. After the securing member is first inserted through the scouring pad from the bottom toward the top, it can then be inserted through the slit and then turned about 90° to hold it firmly in place. The natural resilience of the pad itself helps to do this, since it tends to resume its shape and since the length of the stem between the base and the flattened axial extension is preferably smaller than the thickness of the pad, or at least smaller than the thickness of the pad plus the thickness of the bottom wall of the holder. As a result of this and of the concave shape of the skirt portion, the securing member is lifted to a high enough position that it will not interfere with the scouring operation or come into contact with the surface being scoured.

With this device, both reversal and replacement of the pad are easy, and the operation of the device itself enables the user to use as much force as he wants to without having to hold onto the pad at all. Since the pads can easily be reversed for use on both sides and can be replaced, the device is economical to use.

Other objects and advantages of the invention will appear from the following description of some preferred embodiments.

BRIEF DESCRIPTION OF THE DRAWINGS

In the drawings:

FIG. 1 is a view in perspective of a circular scouring device embodying the principles of the invention.

FIG. 2 is a top plan view of the scouring device of FIG. 1.

FIG. 3 is a bottom view of the scouring device of FIG. 1 with the pad itself removed but its outer perimeter shown by broken lines.

FIG. 4 is a view in section taken along the line 4—4 in FIG. 2, with the outline of the pad shown in broken lines.

FIG. 10 is a view in perspective of another modified form of the invention.

FIG. 11 is a top plan view thereof.

FIG. 12 is a bottom view of the holder and fastener only.

FIG. 13 is a view in section taken along the line 13—13 in FIG. 11, the pad being shown only in outline.

DESCRIPTION OF A PREFERRED EMBODIMENT

The embodiment of FIGS. 1–4

Figure 5:
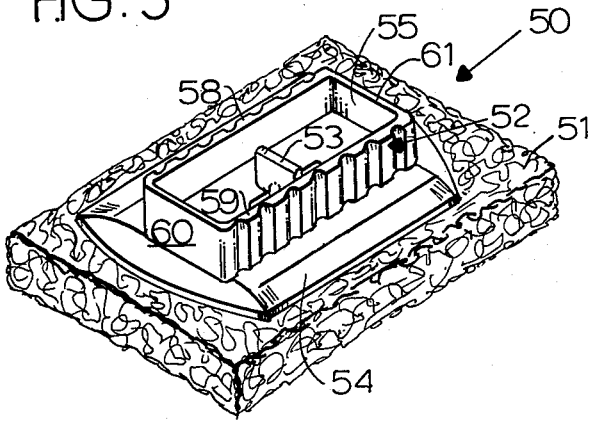
FIG. 5 is a view in perspective of a modified form of scouring pad also embodying the principles of the invention, the device having here a generally rectangular shape.
Figure 6:
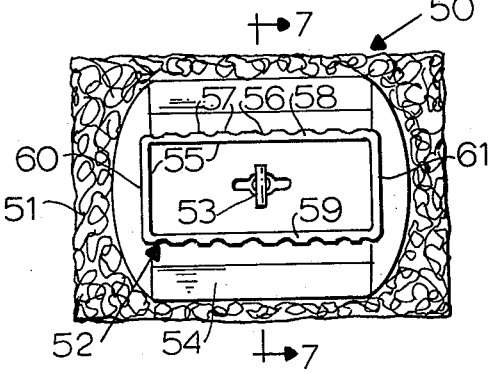
FIG. 6 is a top plan view of the scouring device of FIG. 5.
Figure 7:
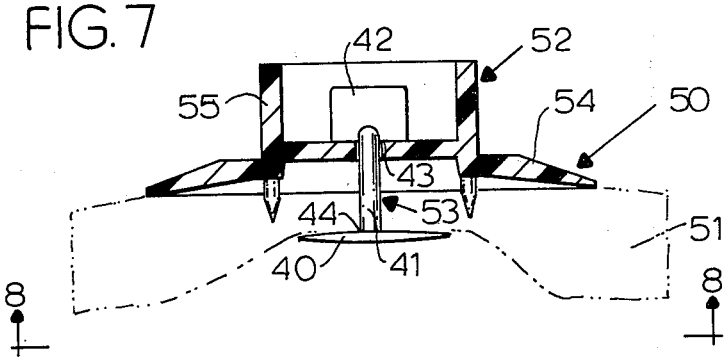
FIG. 7 is a view in section taken along the line 7—7 in FIG. 6, with the pad omitted, but the outline of the pad shown in broken lines.
Figure 8:
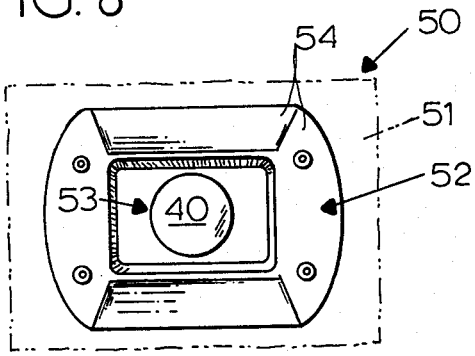
FIG. 8 is a bottom view of the device of FIGS. 5 through 7 looking along the line 8—8 in FIG. 7; the pad is omitted and its perimeter is shown in broken lines.

FIGS. 1–4 show a scouring device 10 having a cylindrical disc-like scouring pad 11, a pad holder 12, and a securing device 13.

The scouring pad 11 may be a pad of woven wire or non-woven fibers of plastic such as nylon, with or without grit or detergent or soap, and it will have a considerable amount of resiliency. Steel wool, metal turnings, and other pads lacking strong cohesiveness cannot be used. The pad 11 must hold together very well. The circular side wall or perimeter 14 of the pad 11 is generally cylindrical, and it is rough since it is made of the kind of material it is. Similarly, the bottom wall 15 and upper wall 16 are generally flat before they are installed into the device 10. It is again to be stressed that only a type of pad that holds itself together under conditions of use is satisfactory. While other pads can be secured to the holder of this invention (and will work with it as well as they work with other holders), the operation is not satisfactory. A typical pad 11 may be about 3¾ inches in diameter and ¾ inch thick.

The pad holder 12 is generally circular in shape. It has an annular depending circular skirt 20 and a circular handle portion 21, the skirt 20 and handle portion being integral with each other and both being rigid. The rigid skirt 20 has a circular periphery 22, and, as can be seen best probably in FIG. 4, the skirt 20 is generally frustoconical with an interior concave surface 23. A central circular bottom wall 24 has a generally flat lower surface 25, but it is set back up even above the inner extremity of the skirt 23, so that the overall effect is that of concavity. This is important in holding the securing member 13 up above the working surfaces of the pad 11. Moreover, there are a plurality, for example four, projections 26 with tapered or sharpened ends 27, that are able to pierce into the pad 11, to engage it and hold it in a stable position, preventing rotation when the pad 11 is installed into the holder 12. These projections 26 are not relied on to fasten the pad 11 to the holder 12; they are used only to prevent the pad 11 from rotating relatively to the holder 12 during scouring.

The rigid handle portion 21 comprises a circular cylindrical rim which surrounds a central circular cavity 30. The upper surface 31 of the bottom wall 24 is exposed, and there is a central through opening 32, round at the middle with extensions to form a flat through slit 33. The slit 33 is centrally located. The rigid handle portion 21 is much higher than the portion of the fastener 13 which will project through and above the opening 32 or slit 33. The outer surface of the circular handle portion 21 is provided with a suitable non-slip gripping surface, such as a series of grooves 35 and ridges 36. The ridges 36 may, in effect, be following the general circular outline, while the grooves 35 may be concave radius portions. The ridges 36 and grooves 35 are made narrow and the spacing is close, so that a finger will ordinarily touch at least two ridges and the groove between them, and in many cases will touch more. The basic idea is to provide a good hand-gripping surface. The upper surface 37 is smooth. The hand will hold much of the rigid handle 21 on the non-slip outer surface 35,36, with fingers often pressing on portions of the rigid skirt 20. The handle 21 is wide enough to lie comfortably in one's hand, being about 2 inches in diameter, and ¾ of an inch high, the cavity being about 1¾ inches in diameter and about ½ inch deep. The skirt 20 may be about ½ inch wide or somewhat wider.

The securing member 13 comprises a flat washer-like base 40 (e.g., about 1 inch in diameter) with an upwardly-extending central stem 41, preferably round, about, for example, ⅜ to ½ inch high. At the upper end of the stem 41 is a generally flat axially-extending portion or head 42, which may be, for example, about ½ inch wide by 1/16 inch thick by ⅜ inch high. This portion 42 and the stem 41 are easily insertable through the opening 32 and slit 33 in the bottom wall 24 of the holder 12. The distance between the lower edge 43 of the portion 42 and the upper surface 44 of the base 40—that is, the length of the actual stem 41—is preferably approximately equal to or less than the actual thickness of the pad 11, and is definitely less than the thickness of the pad 11 plus the thickness of the bottom wall 24. The portion 42 is shorter (vertically) than the wall 21, so that it all lies well below the upper surface 37 of the wall 21 and does not interfere with holding and using the scouring device 10 at the same time, the central cavity 30 is large enough so that it is easy to change pads 11 by manipulation of the scouring member 13.

For installation, the securing member 13 is inserted through an opening that has previously been provided through the pad 11, with the base portion 40 remaining on what is to be the bottom surface 15 of the scouring pad 11 and the portions 42 and 41 passed up through the prepared opening through the pad 11, which is positioned at the center thereof. (Note that the pad 11 can later be inverted to double its life.) If the pad is made of devices from woven wire, the pad 11 will have a metal central grommet or eyelet which compresses the material at the center and holds the pad together, and this grommet or eyelet is shaped to provide the opening to receive the portions 41 and 42. If the pad 11 is made from a nylon fibrous mat or similar plastic fibrous mats, a simple punched hole is sufficient. Yet, although steel wool pads or cotton waste ends could have holes made through them, they are not satisfactory because the material will not hold together. After insertion through a pad 11 the securing device 13 is then aligned with the opening 32,33 and (with the pad 11 in place) the device 13 is pushed up through the opening 32,33 and then given a 90° turn. The projections 26,27 engage the pad 11 to prevent rotation of the pad 11 during scouring, so that the device 13 is the element that is turned during this assembly; usually the device 13 has to be pulled up against the resiliency and substantially spring-like action of the pad 11 itself in order to do this. The spring-like action referred to is a great help in holding the pad 11 in place.

Insertion of the pad 11 with its securing member 13 into the holder 12 forces the pad 11 into the generally concave position shown in FIG. 4 and assures that the bottom of the base 40 will lie above the scouring surface 15 of the pad 11. The scouring is done around or near the edges, and the securing member 13 will not make any contact with the surface being scoured.

During use, the user holds the assembled device 10 with two or three fingers and the thumb or the padded portion of the palm near the thumb. The ridges and grooves 36,35 prevent slippage, and the fingers and thumb or palm may also rest on the skirt 20 to transmit pressure. The device 10 is used with whatever soaps or scouring materials he desires or with none if he so desires. He holds the handle 21 securely by the hand, and he can easily hold it in a way exerting substantial force on the scouring action. It is easy to get into small spaces, such as the corners of pans.

When the bottom surface of the pad 11 becomes worn to the extent that it no longer scours properly, it can be taken out and turned upside down and put back into the handle. Thereby, twice as much use is obtained from each pad as in holders where the pad is glued to the holder. Moreover, when both sides of the pad 11 are worn out, a new pad is easily inserted into the holder 12, as the holder 12 is not discarded.

The rectangular device of FIGS. 5–8

The device 50 of FIGS. 5–8 is substantially like that of FIGS. 1–4 except as to shape. Here the scouring device 50 comprises a rectangular pad 51, a generally rectangular holder 52, and a securing device 53 which may, in fact, be identical to the securing device 13. The pad 11 is no different except for its shape. The holder 52 is basically the same except for its shape. Here is a concave rectangular skirt 54 and a rectangular handle 55 with grooves 56 and ridges 57 lying along the sides most convenient for one to handle. In this instance, the two long edges 58 and 59 that are parallel are shown grooved this way, while the short edges 60 and 61 are not since they are probably too far apart for a hand comfortably to hold them. Insertion and operation are the same as in the circular device of FIGS. 1–4.

Figure 9:
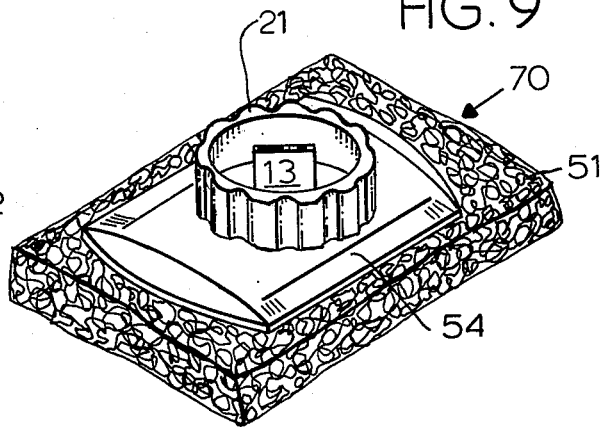
FIG. 9 is a view in perspective of another modified form of the invention, in which a circular handle is used with a rectangular skirt for a rectangular pad.

The scouring device of FIG. 9

The scouring device 70 of FIG. 9 for use with a rectangular pad 51 combines the circular handle portion 21 of the device of FIGS. 1–4 with the rectangular skirt portion 54 of the device of FIGS. 5–8. Some people prefer the circular type of handle but also prefer the rectangular pad 51, and this device 70 is designed for such people. The assembly and operation are quite apparent from what has already been described.

The scouring device 80 of FIGS. 10–13

The scouring device 80 is, in many ways, like the device 10. It may be molded from high-impact plastic, except for the pad 11, which is again used. The securing device 13 is the same as before, also. The device 80 has a holder 81 with a generally cylindrical handle 82 terminating in a sloping skirt 83. The handle 82 is formed with a series of vertical pilaster-like members 84, which meet the skirt 83 at their lower end. The members 84 may terminate somewhat short of an upper end 85 of the handle 82, leaving a smooth portion 86 there. The members 84 may be arcuately shaped, as considered circumferentially, and they provide a circumferential series of ridges and grooves that serve to prevent slippage of the user's fingers. The ridges and grooves provided by the projections 84 are narrow enough and closely spaced enough so that a finger surface will ordinarily be in contact with at least two of the members 84. Again, the user will probably rest his fingertips on the skirt 83, to obtain strong downward pressure on the pad 11, urging it against the object being scoured.

The bundle 82 again surrounds a central cavity 87, affording ready access to the head 42 of the securing device 13, while the head 42 lies well below the upper end 85 and does not interfere with holding the handle 82 during scouring. The bottom of the cavity 87 is a generally flat wall 88, preferably with a shallow groove 89 transverse to a slit-like through opening 90 having a round central portion 91. The groove 89 helps to retain the head 42 after insertion of the pad 11 and securing device 13 into the holder 81, the head 42 being turned to align with the groove 89.

The bottom of the holder 81 is much like that of the holder 12. The lower surface 92 of the skirt 83 is parallel to its upper surface and is frustoconical, sloping up toward center, and the central portion has a flat lower surface 93 which is inset well above the skirt 83 by a generally vertical wall 94, to insure that the portion 40 of the securing device 13 will be held well above the surface to be scoured. Integral projections 95 engage the pad 11 to prevent its rotation.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A scouring device, including in combination:

a shaped scouring pad of the type that holds together well during scouring, having substantially flat upper and lower surfaces, a regular perimeter, and a central slit-like through opening, a rigid pad holder having a rigid handle portion comprising an open top, vertical wall surrounding a central unencumbered cavity having a flat bottom wall with a central slit-like opening therethrough, and a downwardly and outwardly sloping, frustoconical, rigid skirt portion surrounding the lower end of said vertical wall and having a smaller perimeter than that of said pad and downwardly and outwardly sloping upper and lower surfaces, said holder having an upwardly recessed lower surface below said flat bottom wall and having downwardly extending projections for engaging and holding the pad against rotation, and a securing member for securing said pad to said rigid holder, having a generally flat broad base with an upwardly extending stem having at its upper end a flattened narrow vertical head for insertion through the through opening of said pad and then through said slit-like opening of said bottom wall, said securing member, when installed, lying about 90° to said slit-like opening of said bottom wall and securing the pad and holder together, the length of the stem between the base and the head being slightly less than the sum of the thickness of the pad and the thickness of said bottom wall, so that the pad is somewhat compressed at its center and so that its tendency to regain its normal shape helps to hold the elements together against accidental turning of said securing member, whereby the pad is urged into engagement with the lower surface of said holder, said cavity being deeper than the height of said head above said bottom wall, so that the top of said head lies below the upper end of said vertical wall, said bottom surface of said bottom wall being recessed sufficiently above said skirt so that during scouring, the base of said securing member is held above the surface being scoured.

2. The device of claim 1 wherein said vertical wall of said handle is provided with an outer wall having vertical, closely spaced ridges and grooves for affording a gripping surface, the width and spacing of the ridges and grooves being such that each finger of a user will ordinarily bridge at least two grooves when the device is held in the hand for use.

3. The device of claim 1 wherein the upper surface of said bottom wall includes means for aiding in holding said head at about 90° to said slit-like opening of said bottom wall.

4. A scouring device, including in combination:

a circular disc-shaped scouring pad of the type that holds together well during scouring, having substantially flat upper and lower surfaces, a circular perimeter, and a central slit-like through opening, a rigid pad holder having a rigid handle portion comprising an open top, vertical circular cylindrical wall surrounding a central circular cavity having a flat bottom wall with a central slit opening therethrough, and a downwardly and outwardly sloping, frustoconical, rigid circular skirt portion surrounding the lower end of said vertical wall and having a smaller circumference than that of said pad and downwardly and outwardly sloping upper and lower surfaces, said holder having an upwardly recessed lower surface below said flat bottom wall and having downwardly extending projections for engaging and holding the pad against rotation, a securing member for securing said pad to said rigid holder, having a generally flat broad base with an upwardly extending stem having at its upper end a flattened narrow vertical head for insertion through the through opening of said pad and then through said slit opening of said bottom wall, said securing member, when installed lying at about 90° to said slit opening of said bottom wall so as to secure the pad and holder together, the length of the stem between the base and the head being slightly less than the sum of the thickness of the pad and the thickness of said bottom wall, so that the pad is somewhat compressed at its center and so that its tendency to regain its normal shape helps to hold the elements together against accidental turning of said securing member, whereby the pad is urged into engagement with the lower surface of said holder, said cavity being deeper than the height of said head above said bottom wall, so that the top of said head lies below the upper end of said vertical wall, said bottom surface of said bottom wall being recessed sufficiently above said skirt so that during scouring, the base of said securing member is held above the surface being scoured.

5. The device of claim 4 wherein said vertical circular cylindrical wall of said handle comprises an endless series of vertical, closely spaced ridges and grooves for affording a gripping surface, the width and spacing of the ridges and grooves being such that each finger of a user will ordinarily bridge at least two grooves when the device is held in the hand for use.

6. The device of claim 4 wherein said flat bottom wall has on its upper surface an inset portion lying at a right angle to said central slit opening for receiving the bottom edge of said head so as to hold it in place there.

7. A scouring device, including in combination:

a rectangular scouring pad of the type that holds together well during scouring, having substantially flat upper and lower surfaces, a regular rectangular perimeter with straight sides, and a central slit-like through opening parallel to two of the sides of said pad, a rigid pad holder having a rigid handle portion comprising a vertical rectangular wall surrounding a central rectangular cavity having a flat bottom wall with a central slit opening therethrough parallel to two sides of said pad, and a downwardly and outwardly sloping, frustoconial, rigid skirt portion surrounding the lower end of said vertical wall and having a smaller perimeter than that of said pad and downwardly and outwardly sloping upper and lower surfaces, said holder having an upwardly recessed lower surface below said flat bottom wall and having downwardly extending projections for engaging and holding the pad against rotation, a securing member for securing said pad to said rigid holder, having a generally flat broad base with an upwardly extending stem having at its upper end a flattened narrow vertical head for insertion through the through opening of said pad and then through said slit opening of said bottom wall, said securing member then being turned about 90° to secure the pad and holder together, the length of the stem between the base and the head being slightly less than the sum of the thickness of the pad and the thickness of said bottom wall, so that the pad is somewhat compressed at its center and so that its tendency to regain its normal shape helps to hold the elements together against accidental turning of said securing member, whereby the pad is urged into engagement with the lower surface of said holder, said cavity being deeper than the height of said head above said bottom wall, so that the top of said head lies below the upper end of said vertical wall, said bottom surface of said bottom wall being recessed sufficiently above said skirt so that during scouring, the base of said securing member is held above the surface being scoured.

8. The device of claim 7 wherein two said vertical side walls of said handle are provided with a series of vertical, closely spaced ridges and grooves for affording a gripping surface, the width and spacing of the ridges and grooves being such that each finger of a user will ordinarily bridge at least two grooves when the device is held in the hand for use.

9. A scouring pad holder, comprising a single unitary rigid member having a rigid handle portion comprising a vertical wall surrounding a central cavity having a flat bottom wall with a central slit opening therethrough, and a downwardly and outwardly sloping, frustoconical, rigid skirt portion surrounding the lower end of said vertical wall and having downwardly and outwardly sloping upper and lower surfaces, said holder having an upwardly recessed lower surface below said flat bottom wall and having downwardly extending projections.

10. The holder of claim 9 wherein said vertical wall of said handle is provided with exterior vertical, closely spaced ridges and grooves for affording a gripping surface, the width and spacing of the ridges and grooves being such that each finger of a user will ordinarily budge at least two grooves when the device is held in the hand for use.

11. The holder of claim 10 wherein said handle portion and said skirt portion are both circular and the ridges and grooves completely encircle said handle.

12. The holder of claim 11 wherein said flat bottom wall has an inset groove in its upper surface perpendicular to and intersecting the center of said central slit opening.

13. The holder of claim 10 wherein said handle portion is circular and the ridges and grooves completely encircle it and wherein said skirt portion is generally rectangular.

14. The holder of claim 10 wherein both said handle portion and said skirt portion are both generally rectangular with said ridges and grooves on two parallel side walls of said handle portion.

* * * * *

UNITED STATES PATENT AND TRADEMARK OFFICE

CERTIFICATE OF CORRECTION

PATENT NO. : 4,085,475

DATED : April 25, 1978

INVENTOR(S) : Louis J. Silver

It is certified that error appears in the above-identified patent and that said Letters Patent are hereby corrected as shown below:

Column 1, lines 23-24, delete "none of which work for long".
Column 7, line 13, "slit-like" should read --slit--.
line 29, "slit-like" should read --slit--.
line 31, "slit-like" should read --slit--.
line 59, "slit-like" should read --slit--.
line 68, before "cavity" insert --unencumbered--.
Column 8, line 56, "a vertical" should read --an open top, vertical--.
line 57, before "cavity" insert --unencumbered--.
Column 10, line 1, "a vertical" should read --an open top, vertical--.
line 1, before "cavity" insert --unencumbered--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*